US007320371B2

(12) United States Patent
Mocivnik et al.

(10) Patent No.: US 7,320,371 B2
(45) Date of Patent: Jan. 22, 2008

(54) METHOD AND DEVICE FOR PRODUCING PRETENSIONED ANCHORINGS

(75) Inventors: Josef Mocivnik, Fohnsdorf (AT); Renè Egger-Mocivnik, Judenburg (AT); Alfred Wagner, Linz (AT); Karl Böhm, Holzhausen (AT)

(73) Assignee: "ALWAG" Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 11/523,669

(22) Filed: Sep. 20, 2006

(65) Prior Publication Data

US 2007/0012482 A1 Jan. 18, 2007

Related U.S. Application Data

(63) Continuation of application No. PCT/AT2005/00101, filed on Mar. 22, 2005.

(30) Foreign Application Priority Data

Mar. 23, 2004 (AT) ..... A 509/2004

(51) Int. Cl.
*E21B 7/20* (2006.01)
*E02D 5/74* (2006.01)
*E02D 23/08* (2006.01)

(52) U.S. Cl. ..... 175/57; 175/171; 405/244; 405/249; 405/251

(58) Field of Classification Search ..... 175/414, 175/415, 22, 171, 417, 57; 405/232, 233, 405/244, 249, 251, 255
See application file for complete search history.

(56) References Cited

U.S. PATENT DOCUMENTS

| | | | | |
|---|---|---|---|---|
| 3,436,923 | A | 4/1969 | Lagerstrom | |
| 3,610,346 | A * | 10/1971 | Ziober | 175/5 |
| 4,636,115 | A | 1/1987 | Davis et al. | |
| 5,540,294 | A * | 7/1996 | Anderberg | 175/19 |
| 6,368,021 | B1 * | 4/2002 | Strong et al. | 405/228 |
| 6,536,993 | B2 * | 3/2003 | Strong et al. | 405/228 |
| 7,080,697 | B2 * | 7/2006 | Mocivnik | 175/22 |

FOREIGN PATENT DOCUMENTS

| | | |
|---|---|---|
| CH | 447989 | 3/1968 |
| DE | 693918 | 7/1940 |
| DE | 1104905 | 4/1961 |

(Continued)

*Primary Examiner*—Kenneth Thompson
(74) *Attorney, Agent, or Firm*—Jacobson Holman PLLC

(57) ABSTRACT

A method and device for boring, particularly percussion boring or rotary percussion boring, a hole in soil or rock material and for forming an anchoring. A borehole is formed by inserting a drill bit, and a casing tube is placed inside the borehole during the boring process. Once the borehole is completed, the boring rods are detached from the drill bit and removed from the borehole. The periphery of the casing tube is provided with a number of passage openings for discharging hardenable material. A tensioning device for the anchor, particularly an anchor plate and a screw that can be screwed onto the casing tube, can be fixed to the end of the casing tube protruding from the borehole. Anchoring or fixing elements for anchoring the casing tube on the surrounding inner wall of the borehole are provided, in particular, on the end area of the casing tube oriented toward the drill bit.

20 Claims, 5 Drawing Sheets

FOREIGN PATENT DOCUMENTS

| | | |
|---|---|---|
| DE | 1484440 | 6/1969 |
| DE | 1484572 | 3/1970 |
| DE | 4024869 | 2/1991 |
| EP | 0047727 | 3/1982 |
| EP | 0077762 | 4/1983 |
| EP | 0079875 | 5/1983 |
| EP | 0016742 | 6/1984 |
| EP | 0112316 | 6/1984 |
| EP | 0207030 | 12/1986 |
| FR | 816086 | 7/1937 |
| FR | 1375895 | 9/1963 |
| WO | WO91/06713 | 5/1991 |
| WO | WO97/31177 | 8/1997 |
| WO | WO98/21439 | 5/1998 |
| WO | WO98/58132 | 12/1998 |

* cited by examiner

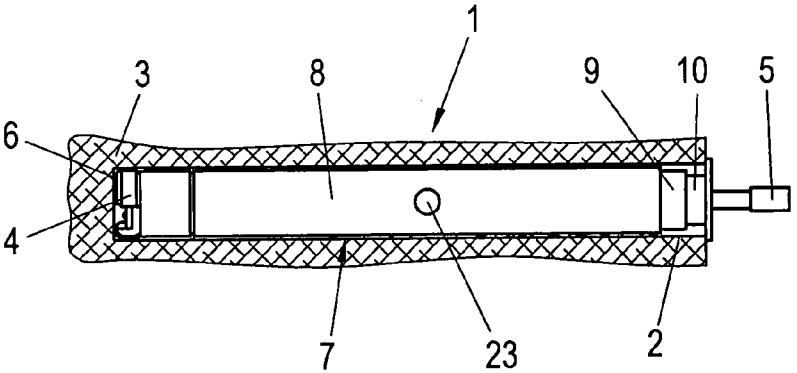
FIG. 1a
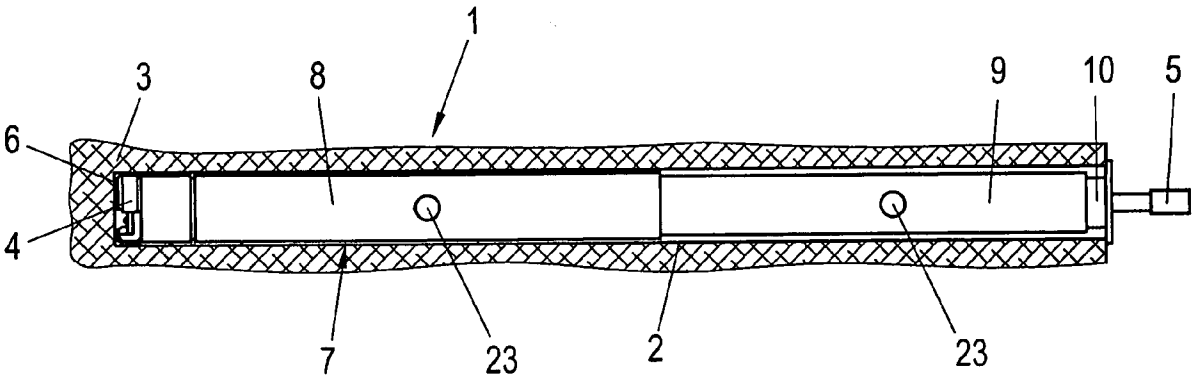
FIG. 1b
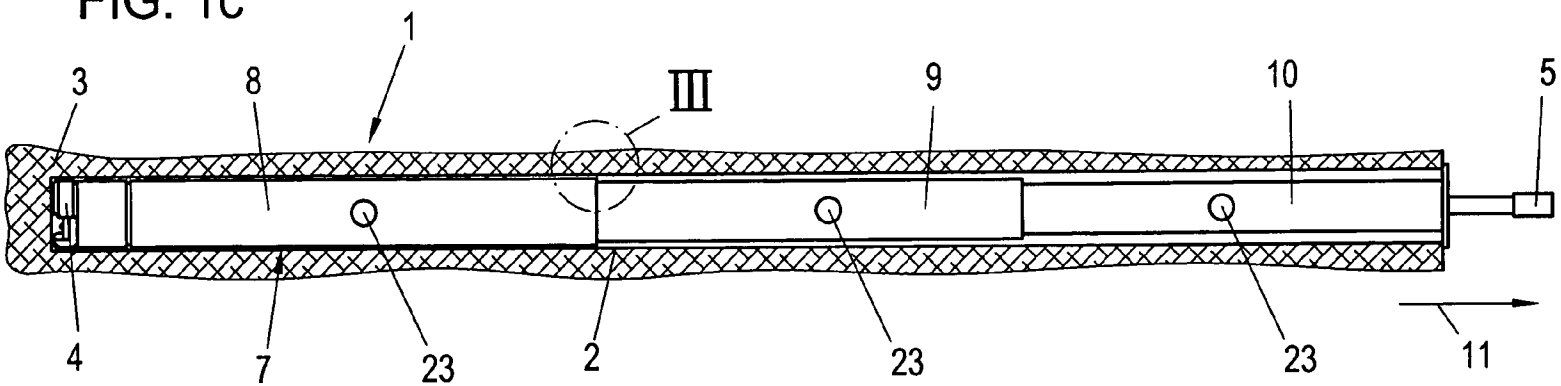
FIG. 1c
FIG. 1

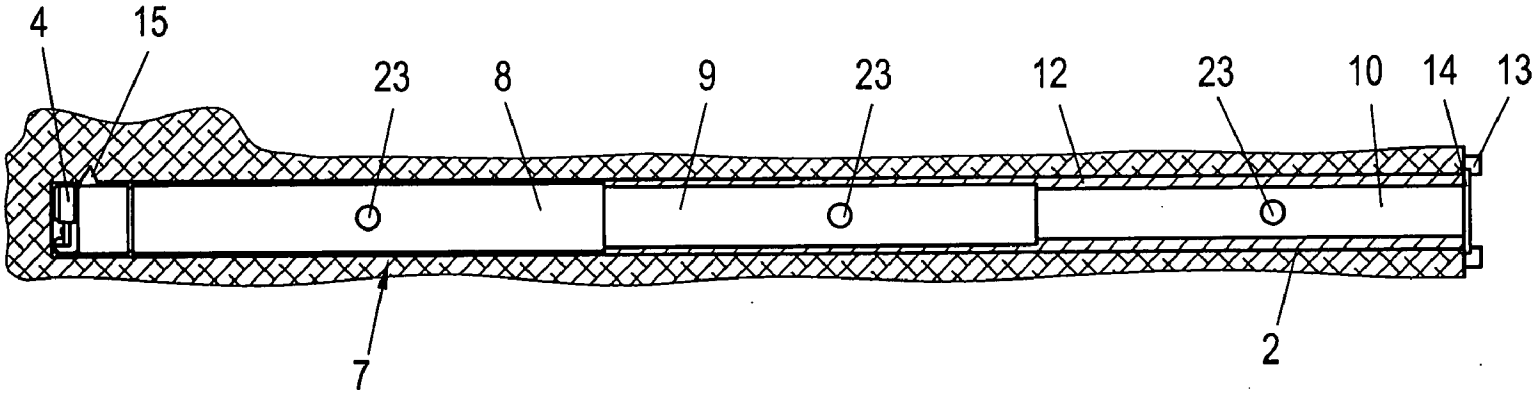
FIG. 1
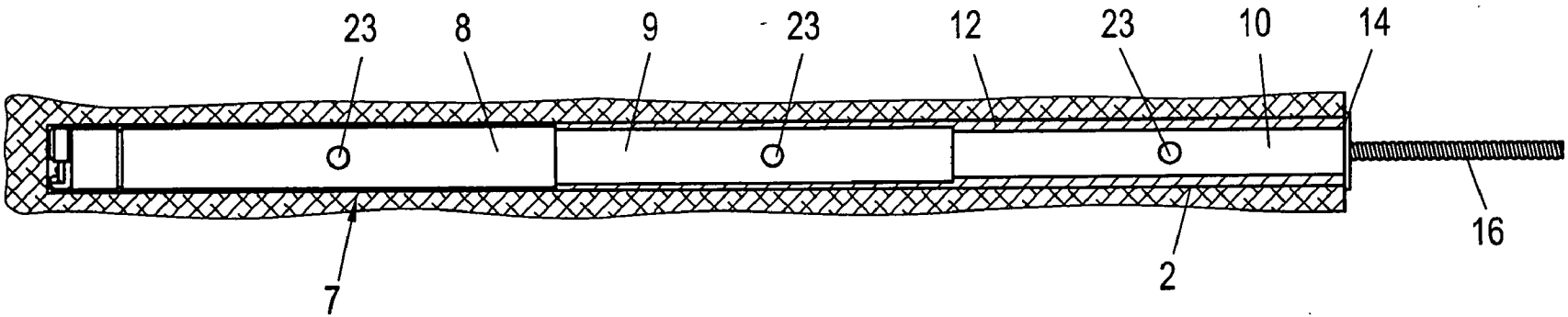
FIG. 1d
FIG. 1e

FIG. 6
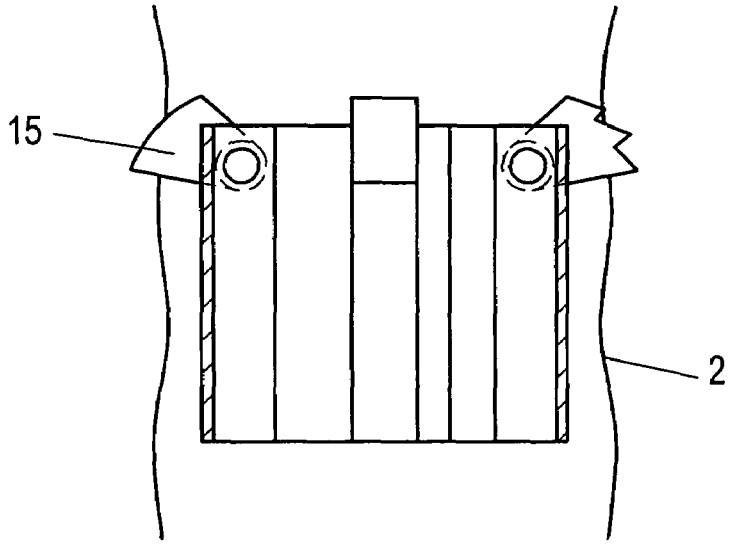
FIG. 6a
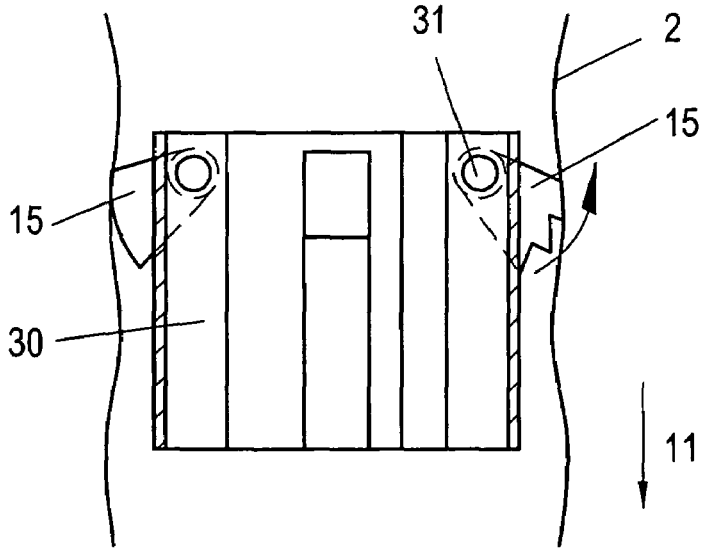
FIG. 6b

METHOD AND DEVICE FOR PRODUCING PRETENSIONED ANCHORINGS

This is a continuation of PCT/AT05/000101 filed Mar. 22, 2005 and published in German.

FIELD OF THE INVENTION

The present invention relates to a method for drilling, in particular percussion drilling or rotary percussion drilling, a hole in soil or rock material and for forming an anchoring in said hole, wherein a borehole is formed by the introduction of a drill bit mounted on a drill rod assembly and a jacket tube is introduced into the borehole during the drilling procedure, wherein the drill rod assembly is separated from the drill bit and removed from the borehole upon completion of the borehole. The invention further relates to a device for drilling, in particular percussion drilling or rotary percussion drilling, a hole in soil or rock material and for forming an anchoring, wherein a borehole is formed by the introduction of a drill bit and a jacket tube is introduced into the borehole during the drilling procedure, wherein the drill rod assembly is separated from the drill bit and removed from the borehole upon completion of the borehole.

PRIOR ART

From DE 14 84 440 A1 a method for drilling a hole and for forming an anchoring in the hole is known, wherein a bore hole is formed by the introduction of a drill bit mounted on a drill rod assembly and a jacket tube is introduced into the bore hole during the drilling procedure, wherein the drill rod assembly is separated from the drill bit and removed from the bore hole upon completion of the bore hole, wherein a curable fluid is introduced in a space between the jacket tube and the bore hole wall, wherein the jacket tube is secured on the curable fluid and wherein after curing of this fluid the jacket tube is pretensioned. Furthermore, from FR 1 375 895 A the pretensioning of the jacket tube before curing a curable fluid is known.

In the context of the production of a hole or borehole in soil or rock material and the subsequent formation or fixation of an anchoring or lining in the borehole, it is, for instance, known from WO 98/21439 and WO 98/58132 to introduce a jacket tube into the borehole during the drilling procedure, for instance percussion drilling or rotary percussion drilling, whereupon, after the completion of the bore, optionally a part of the drill bit is removed from the borehole together with the drill rod assembly, while the jacket tube remains in the borehole such that an anchor will subsequently be formed within the borehole by filling a curing mass into the same. According to the configuration set out in WO 98/58132, the drill rod assembly can be provided with additional ribs and grooves on its outer periphery in order to provide an accordingly good anchoring effect with the drill rod assembly remaining in the borehole and being subsequent filled.

Alternatively, it is known, after the production of a borehole, to remove the drilling tool together with the drill rod assembly from the borehole, whereupon an anchor or anchoring means usg subsequently introduced into the borehole, wherein it is, for instance, referred to EP-A 0 079 875, EP-B 0 047 727, EP-B 0 207 030, EP-B 0 016 742, EP-A 0 077 762, WO 97/31177, EP-A 0 112 316, WO 91/06713, DE-A 40 24 869 or U.S. Pat. No. 4,636,115. In that known prior art, after the completion of a borehole and subsequent removal of the drilling device, expandable anchoring elements are introduced into the borehole, which are kept at a reduced diameter relative to the borehole during their introduction into the borehole, whereupon, after the complete introduction into the borehole, expandable partial regions of the anchoring device, which are folded during the introduction or generally reduced in terms of cross section, are expanded.

Furthermore, anchor or tension rod configurations or methods for fixing the same in soil or rock material can, for instance, be taken from DE 693 918, FR 816 086, DE 1 104 905 or DE 1 484 572, said anchor elements being again introduced substantially after the completion of a borehole and subsequent removal of the drilling device.

That known prior art, in particular, involves the drawback that the borehole must be produced in a first method step, whereupon, after the removal of the drilling tool together with the drill rod assembly, the anchoring device is introduced into the optionally very long borehole in a further method step. It is immediately apparent that the two separate operating steps not only require accordingly more time, but that optionally the subsequent introduction of such an anchoring device having a great length may entail problems. Furthermore, it is to be anticipated that the removal of the drilling device together with the drill rod assembly and the subsequent introduction of an anchoring device is feasible only in comparatively solid soil or rock, where it must be safeguarded that no material will break into the borehole, for instance, during the drilling procedure or after the removal of the drilling tool and prior to the final introduction of the anchoring device, which would block the borehole and, hence, render the introduction of the anchoring device impossible.

Moreover, it is, for instance, known to arrange so-called packers about the outer periphery of the drill rod assembly of a drilling device, which enable an expansion into abutment on the borehole wall over a short partial region upon completion of the bore, thus acting against an extraction or removal of the drill rod assembly from the borehole. By means of such packers, it is, however, impossible to provide a reliable anchoring effect intended to stabilize the surrounding soil or rock material, particularly where a plurality of anchors to be adjacently arranged are provided, so that additional anchoring means such as, for instance, the application of a curing material will optionally have to be provided.

Departing from the prior art mentioned in the beginning, the present invention aims to provide a method and device of the initially defined kind, which enable the formation of an anchoring immediately after the completion of a borehole, in particular, to stabilize the surrounding soil or rock material, yet with a simplified overall construction and, in particular, reduced time expenditure.

SUMMARY OF THE INVENTION

To solve these objects, a method of the initially defined kind is essentially characterized in that the jacket tube is secured to the borehole wall particularly in the end region facing the borehole interior, that a curable fluid is fed into a free space between the outer periphery of the jacket tube and the inner periphery of the borehole wall, and that tensioning of the anchor-forming jacket tube is effected prior to the final solidification of the curable fluid. Due to the fact that, according to the invention, the securement of the jacket tube to the borehole wall and the introduction of a curable fluid into a free space between the outer periphery of the jacket tube and the inner periphery of the borehole wall are effected upon completion of the borehole and removal of the drill rod assembly and, optionally, part of the drill bit, a stabilization and compaction of the surrounding soil or rock material are immediately feasible during the subsequent tensioning or bracing of the anchor-forming jacket tube. It is, thus, ensured that a curable fluid introduced into the free space between the outer periphery of the jacket tube and the inner periphery of the borehole wall is appropriately solidified by the tensioning of the anchor-forming jacket tube, and that the free space between the outer periphery of the jacket tube and the inner periphery of the borehole wall is reliably and completely filled with the curable fluid so as to obtain the desired connection between the jacket tube or anchor and the surrounding soil or rock material as well as the anchoring effect and stabilization and compaction of optionally different soil and rock layers through which the anchor formed by the jacket tube is passed.

A simple and reliable introduction of the curable fluid into the annular-space-forming free space between the outer periphery of the jacket tube and the surrounding borehole inner wall is achieved according to a preferred embodiment in that the curable fluid is introduced into the free space between the outer periphery of the jacket tube and the inner periphery of the borehole wall via passage openings provided about the periphery of the jacket tube. The curable fluid can, thus, be introduced through the interior of the jacket tube, reaching the free space between the outer periphery of the jacket tube and the inner periphery of the borehole wall through passage openings provided about the periphery of the jacket tube, so that the complete filling of the free space between the outer periphery of the jacket tube and the inner periphery of the borehole wall will be safely ensured even in the event of optionally large borehole lengths. It is, therefore, not necessary to introduce a curable material, for instance, from the outer side of the jacket tube or anchor into the free space provided between the jacket tube and the borehole inner wall and optionally having a large diameter or cross section.

For a particularly reliable introduction of curable material through the passage openings provided about the periphery of the jacket tube, it is proposed according to a further preferred embodiment that the curable fluid is fed through the interior of the jacket tube via a supply duct introduced into the interior of the jacket tube and having supply duct feed openings provided in the region of the passage openings of the jacket tube.

Particularly if the filling with a curable fluid, of the interior defined by the anchor-forming jacket tube is not required or reasonable, it is proposed according to a further preferred embodiment that sealing elements for sealing the annular space formed between the outer periphery of the supply duct and the inner periphery of the jacket tube are provided on the outer periphery of the supply duct for the curable fluid, in the vicinity of the feed openings for the curable fluid, whereby it is safeguarded that the curable fluid will reach the respective regions of the passage openings of the jacket tube and be reliably fed into the free space between the jacket tube and the borehole inner wall via said passage openings in order to enable the proper anchorage of the jacket tube in the curing material and in the bond with the surrounding soil and rock material.

To support the anchoring effect by the anchor-forming jacket tube during the tensioning of the latter, it is proposed according to a further preferred embodiment that that the jacket tube is designed to have an outer diameter increasing or widening towards the borehole interior at least on its outer periphery. Such a widening or increasing diameter provides an appropriate wedge effect in the tensioning to be performed, so as to ensure the reliable compaction and filling of the free space between the outer periphery of the jacket tube and the inner periphery of the borehole wall with the curable fluid prior to its final solidification and, hence, an enhanced anchoring effect.

An increasing or enlarging diameter of the jacket tube in the direction of the borehole interior will, for instance, be obtained in that the jacket tube is comprised of mutually telescopically insertable jacket tube elements forming step-like regions on the outer periphery, as in accordance with a further preferred embodiment of the invention. In this manner, not only reliable tensioning while distributing the curable material introduced into the free space between the jacket tube and the borehole inner wall is feasible, but also cumbersome operating steps involved in the extension of a jacket tube in the event of large borehole lengths will be avoided, since the individual jacket tube sections or elements are telescopically inserted or insertable into each other and extractable with the borehole length progressing.

If the forces introduced through the jacket tube during tensioning while taking into account the curable material fed into the free space between the outer diameter of the jacket tube and the borehole inner wall are insufficiently high, it is provided according to a further preferred embodiment, in order to increase the anchoring effect, that an additional anchorage is introduced into the interior of the anchor-forming jacket tube.

For the reliable introduction of such an additional anchorage even in the event of large borehole lengths, it is, moreover, provided in a preferred manner that the additional anchorage is guided on the inner periphery of the jacket tube, particularly on its end facing the borehole interior.

In order to guarantee the anchoring effect provided by the additional anchorage, it is contemplated according to a further preferred embodiment that the additional anchorage is fixed or anchored to the drill bit and/or, in the region of the guidance, to the jacket tube inner wall.

In order to further assist the anchoring effect when using an additional anchoring element, it is proposed according to a further preferred embodiment that the interior of the jacket tube is filled with a curable fluid after the introduction of said additional anchorage.

To solve the objects set out in the beginning, a device of the initially defined kind, moreover, is essentially characterized in that the anchor-forming jacket tube on its periphery is formed with a plurality of passage openings for feeding a curable material into a free space between the outer periphery of the jacket tube and the inner periphery of the borehole wall, that a tensioning means for the anchor, in particular an anchor plate and a screw capable of being screwed onto the jacket tube, is fixable to the jacket tube end projecting out of the borehole, and that anchoring or fixing elements for anchoring the jacket tube to the surrounding borehole inner wall are provided, particularly in the jacket tube end region facing the drill bit. As already indicated above, a structurally simple construction, thus, helps ensure that the anchor-forming jacket tube, after the completion of a borehole and removal of the drill rod assembly, and optionally partial removal of the drill bit, is reliably secured particularly on its end facing the borehole interior, whereupon, after the introduction of a curable fluid or material into the free space between the outer diameter of the jacket tube and the borehole inner wall, tensioning by the aid of a tensioning device has become feasible. In a manner known per se, such a tension device may, for instance, be comprised of a tension plate contacting the anchor-forming jacket tube outside of the borehole as well as an appropriate screw connection.

For a particularly reliable feeding of the curable fluid into the free space between the outer periphery of the jacket tube and the borehole inner wall, it is proposed according to a preferred embodiment that the curable fluid is feedable through the interior of the jacket tube via a supply duct introduced into the interior of the jacket tube and having supply duct feed openings provided in the region of the passage openings of the jacket tube. In this manner, not only the reliable feeding of curable material will be ensured, but also feasible a selected feeding of curable material will be feasible by using a supply duct which, in particular, can be removed again after the introduction of the curable material.

In this context, it is proposed according to a further preferred embodiment that sealing elements for sealing the annular space formed between the outer periphery of the supply duct and the inner periphery of the jacket tube are provided on the outer periphery of the supply duct for the curable fluid, in the vicinity of the feed openings for the curable fluid. It will thereby be safeguarded that the curable material to be fed into the free space between the outer periphery of the jacket tube and the inner periphery of the borehole wall can be substantially supplied in the region of the passage openings of the jacket tube.

As already indicated above, the anchoring effect can be supported by providing a diameter of the anchor-forming jacket tube, that increases, in particular, towards the borehole inner wall, wherein in this context it is proposed according to a further preferred embodiment that the jacket tube is comprised of mutually telescopically insertable jacket tube elements having their outer peripheries or diameters decreasing from the jacket tube end arranged in the borehole interior. Such jacket tube elements which are telescopically insertable into each other will not only enhance or increase the anchoring effect in cooperation with the curable fluid, but also render cumbersome operating steps involved required for the extension of a jacket tube in the event of large borehole lengths superfluous on account of the mutually telescopically insertable jacket tube elements.

To ensure the proper positioning of the adjoining or mutually insertable, telescopic jacket tube elements, it is proposed according to a further preferred embodiment that the telescopic jacket tube elements are each formed in their end regions with cooperating stops or stop surfaces. Such stops or stop surfaces in addition enable the adjustment of a defined length of the anchor-forming jacket tube during tensioning by partially extracting the anchor-forming jacket tube and, hence, the obtainment of the desired anchoring or tensioning effect.

In order to prevent the direct impact of mutually cooperating stops or stop surfaces, which, for the transmission of appropriate forces, at least partially have boundary surfaces extending substantially normally to the axis of the borehole, it is provided according to a further preferred embodiment that wedge-shaped abutment surfaces enclosing acute angles with the axis of the jacket tube are provided in the region of the ends of the jacket tube elements. Such wedge-shaped abutment surfaces cause the continuous increase of, for instance, frictional forces of mutually cooperating stop surfaces such that instantaneous or impact-like stresses in the region of the stops or stop surfaces will be avoided.

For the reliable and adequate securement or fixation of the anchor-forming jacket tube particularly in the end facing the borehole interior, it is provided according to a further preferred embodiment that the fixing elements are comprised of at least one hook or the like, in particular foldout hook, which projects from the outer periphery of the jacket tube. Such hooks will penetrate into the surrounding rock or soil material and, hence, provide securement upon tensioning of the jacket tube. By arranging the pivot axes of the hooks, in particular, on the hook ends facing the borehole interior, the substantially automatic emergence of the hooks will be caused by the retraction of the jacket tube during tensioning, so that no additional and optionally expensive mechanisms for bringing out or extracting the fixing or anchoring elements will be required.

To support the anchoring effect, it is provided according to a further preferred embodiment that an additional anchoring element is introducible into the interior of the jacket tube.

For the reliable and proper introduction of such an additional anchoring element, it is provided according to a further embodiment that the additional anchoring element comprises a guide on its end facing the borehole interior, which guide is arranged, in particular slidingly arranged, along the inner wall of the jacket tube.

In order to separately introduce a tensioning force onto the device according to the invention by the additional anchorage too, it is provided according to a further preferred embodiment that the additional anchorage is comprised of a solid rod provided, in particular, with an external profile. The improvement or enhancement of the anchoring performance to be attained by the additional anchorage, departing from a solid rod having a substantially smooth surface, can be further enhanced by using a solid rod having, for instance, a thread-like external profile, in which case it is preferred to additionally fill the hollow space of the jacket tube or anchor as already indicated above, so that the anchoring effect will be supported and increased by the combined action with the profiled outer surface.

In the context of increasing the anchoring effect by using an additional anchorage, it is provided according to a further preferred embodiment that the additional anchorage is fixable or anchorable to the drill bit and/or, in the region of the guide, to the jacket tube inner wall, so as to enable the safe and reliable fixation of the additional anchorage in the anchor-forming jacket tube even with optionally large borehole lengths.

In particular, with a configuration of the anchor-forming jacket tube having a diameter widening towards the borehole interior by the stepwisely adjoining, telescopic jacket tube elements, and optionally by providing the additional anchorage, an accordingly high anchoring effect will be obtained with jacket tube elements having substantially smooth surfaces while, at the same time, taking into account the curable fluid introduced into the free space between the outer diameter of the jacket tube and the borehole inner wall.

SHORT DESCRIPTION OF THE DRAWINGS

In the following, the invention will be explained in more detail by way of exemplary embodiments schematically illustrated in the accompanying drawing. Therein:

FIG. 1 depicts schematic side views of different steps in the realization of the method according to the invention using the device according to the invention, FIG. 1*a* showing a first step of the drilling procedure according to the invention, FIG. 1*b* showing an intermediate step of the drilling procedure according to the invention, FIG. 1*c* showing the step of a completed bore, FIG. 1*d* showing the step of the tensioning an anchor-forming jacket tube after the introduction of a curable material, and FIG. 1*e* showing the step of introducing an additional anchorage;

Figure 4:
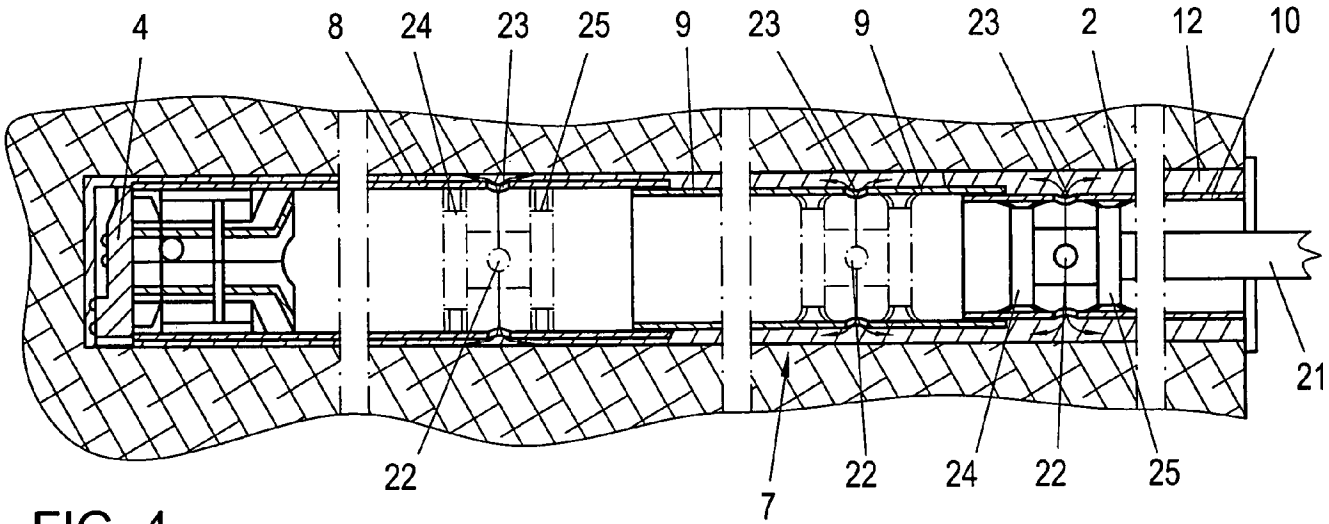
FIG. 4 is a schematic partial section through a device according to the invention during the introduction of a curable material into the free space or annular space between the outer periphery of the jacket tube and the inner periphery of the borehole wall.
Figure 5:
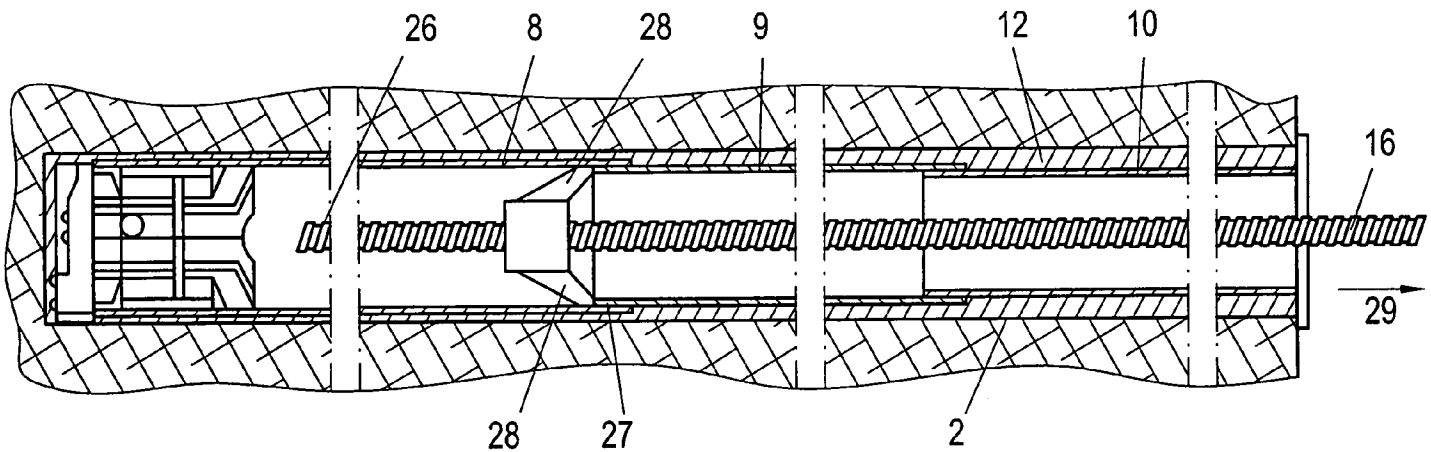

FIG. 5, in an illustration similar to that of FIG. 4, again depicts a section through a device according to the invention during the introduction of an additional anchorage into the interior of the anchor-forming jacket tube; and FIG. 6, on an enlarged scale, depicts schematic illustrations of fixing elements used to secure the anchor-forming jacket tube, in particular, on the end facing the interior of the borehole, FIG. 6*a* illustrating the state of completely extracted or widened fixing elements and FIG. 6*b* illustrating an intermediate position of the fixing elements.

DESCRIPTION OF THE PREFERRED EMBODIMENTS

FIG. 1 depicts different steps in the production of a borehole using a device, which is generally denoted by 1, for the drilling, in particular percussion drilling or rotary percussion drilling, of a hole 2 in soil or rock material schematically indicated by 3.

In the illustration according to FIG. 1, a schematically indicated drill bit 4 is each provided, which is set into a percussive and/or rotary percussive movement by a drive not illustrated in detail via a drill rod assembly, which is denoted by 5 in FIGS. 1*a* to 1*c* , in order to form the borehole 2, excavation elements 6 being indicated on the drill bit 4.

A jacket tube, which is generally denoted by 7, follows upon the end of the drill bit 4 facing away from the interior of the borehole, wherein it is apparent that the jacket tube 7 is comprised of a plurality of jacket tube elements telescopically arranged one within the other and denoted in the Figures by 8, 9 and 10, respectively.

As a function of the length of a borehole 2 to be produced as well as the length of the individual jacket tube elements 8 to 10, any number differing from that illustrated in the Figures, of mutually telescopically insertable jacket tube elements can be provided.

While FIG. 1*a* illustrates and indicates the beginning of the production of a borehole 2 and FIG. 1*b* an intermediate step in the production of the borehole 2, the individual jacket tube elements 8, 9, 10 in the illustration according to FIG. 1*c* are in their respectively extracted or telescoped states such that FIG. 1*c* indicates the completed bore or completed borehole 2. Upon completion of the borehole 2, the drill rod assembly 5 in a manner known per se is separated form the drill bit 4 and removed from the jacket tube 7 formed by the telescopic elements 8, 9 and 10 in the sense of arrow 11.

Subsequently, a curable fluid like, for instance, injection mortar is fed into the free space between the borehole or borehole inner wall 2 and the outer diameter of the respective jacket tube elements 8, 9 and 10, as will be explained in more detail below with reference to FIG. 4, wherein, prior to the final solidification of the fluid introduced into the free space 12, tensioning of the anchor-forming jacket tube 7, which is comprised of jacket tube elements 8, 9 and 10 in the illustrated embodiment, by the aid of a tensioning means schematically indicated by 13 and contacting the jacket tube element 10 or a respective anchor plate 14 is effected. To this end, the jacket tube 7 is additionally secured in the region of the drill bit 4 and/or on the jacket tube section 8 via schematically indicated fixing elements 15, which will be explained in more detail by way of FIG. 6.

By securing the jacket tube 7 by the aid of the fixing elements 15 as well as tensioning the anchor-forming jacket tube 7, or the individual telescopic jacket tube elements 8, 9 and 10, the proper fixation of the anchor 7 can be ensured. The step-like regions formed between the individual jacket tube elements 8, 9 and 10 in the sense of an enlargement of the outer diameter of the jacket tube 7 in the direction towards the interior of the borehole provide a reliable compaction of the curable fluid introduced into the free space 12, so that a safe adhesion between the outer periphery of the jacket tube 7, or the individual jacket tube elements 8, 9 and 10, and the borehole inner wall 2 will be obtained.

If the anchorage provided by the anchor-forming jacket tube 7 is not sufficient, it is, moreover, indicated in FIG. 1*e* that an additional anchorage comprised of a, particularly profiled, solid rod 16 is introduced into the interior of the jacket tube 7, wherein, in this respect, it is referred to the subsequent description of FIG. 5.

Figure 2:
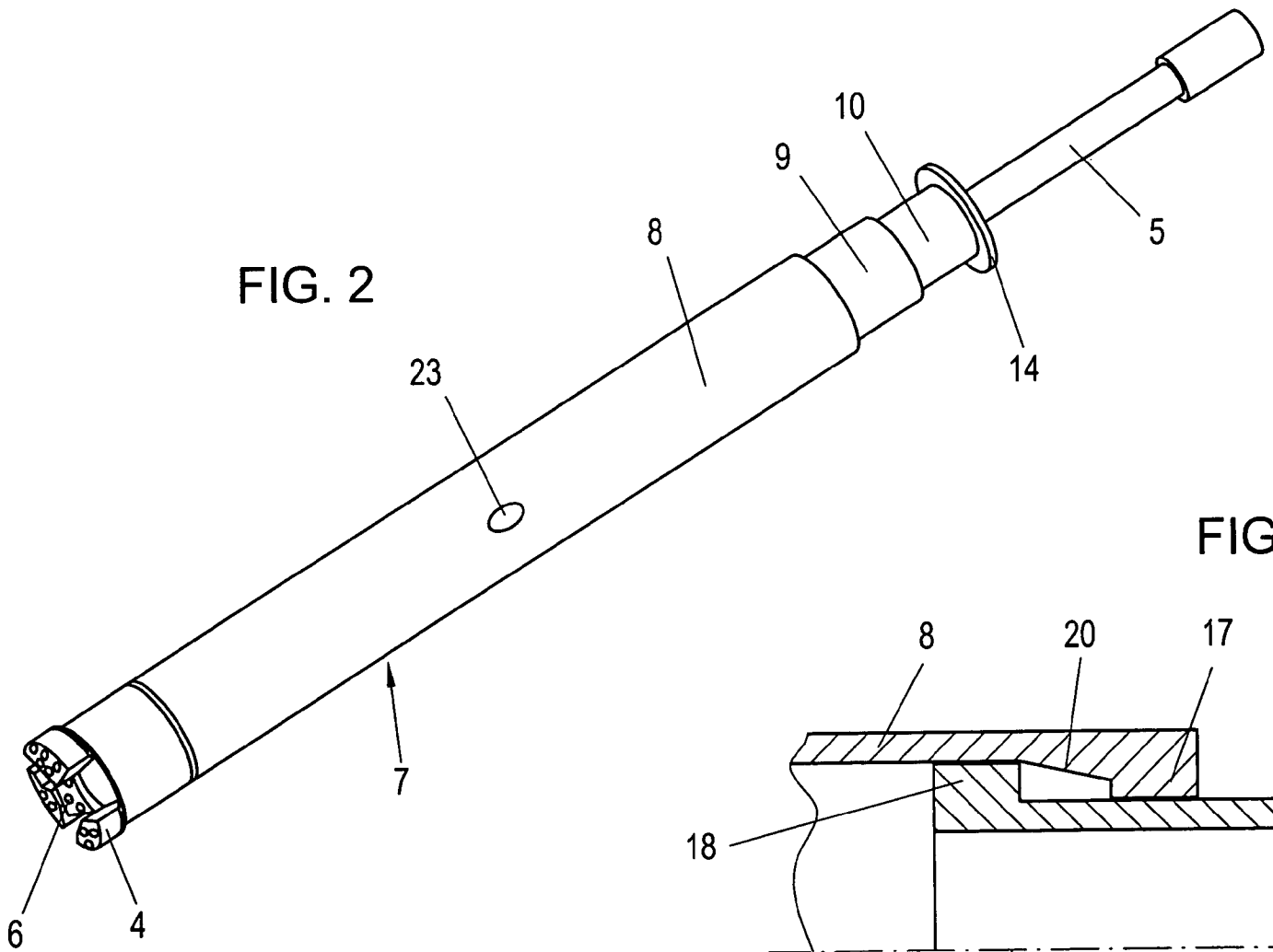
FIG. 2 is a perspective, schematic illustration of a device according to the invention for carrying out the method of the invention.

From the illustration according to FIG. 2, the jacket tube 7 is even more clearly apparent, being comprised of a plurality of mutually telescopically insertable jacket tube elements 8, 9 and 10, with the anchor plate being again denoted by 14. In the illustration according to FIG. 2, the drill rod assembly denoted by 5, which is used to activate the drill bit 4, is again visible.

Figure 3:
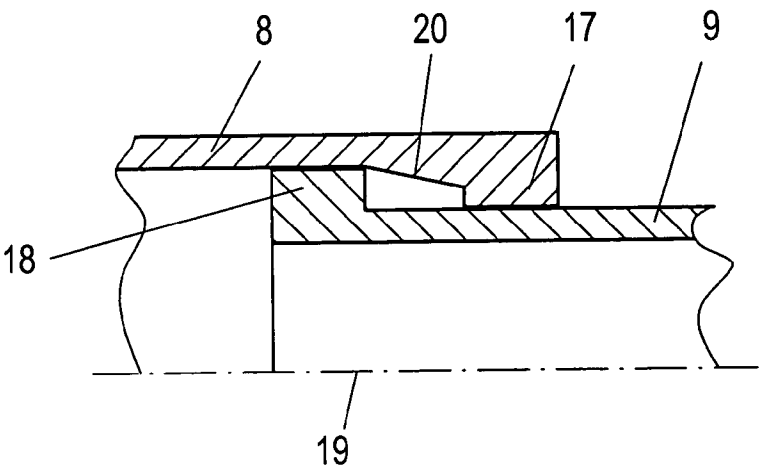
FIG. 3 is a partial section on an enlarged scale, of the region III which, for instance in FIG. 1*c*, is indicated between adjoining telescopic jacket tube elements.

In the enlarged illustration according to FIG. 3, it is to be seen how adjoining jacket tube elements or sections, which are denoted by 8 and 9 in FIG. 3, each comprise stops or stop surfaces 17 and 18, respectively, in their end regions to provide a defined end position of the individual, neighboring telescopic jacket tube sections 8 and 9. While the stops 17 and 18 over a partial region of their extensions extend substantially normally to the axis of the jacket tube 7, or axis of the borehole to be produced, which is schematically denoted by 19, additional wedge-shaped stop or ramp surfaces 20, which enclose acute angles with the jacket tube axis 19, are indicated to avoid the abrupt or direct collision of the stops 17 and 18 and, hence, excessive stresses in these zones. The wedge-shaped ramp or stop surfaces 20 provide an appropriate damping or braking effect and, in addition, secure the adjoining telescopic jacket tube elements 8 and 9 against extraction.

From the schematic illustration according to FIG. 4, it is apparent that, upon completion of the bore and removal of the drill rod assembly 5, a supply duct 21 is introduced into the interior of the jacket tube 7 for the introduction of the curable fluid into the free space 12 between the borehole inner wall 2 and the outer periphery of the individual jacket tube elements 8, 9 and 10, said supply duct 21 including feed openings 22 each on the respective outer peripheries of the jacket tube elements 8, 9 and 10 in the region of the respective passage openings 23. Furthermore, sealing elements 24 and 25 are indicated consecutively to the feed openings 22, which define an annular space for feeding the curable material via the passage openings 23 provided about the peripheries of the individual jacket tube elements 8, 9 and 10.

It may be envisaged that the supply duct 21, in accordance with the passage openings 23 of the jacket tube 7, or the individual jacket tube sections 8, 9 and 10, comprises a plurality of feed openings 22 and respective sealing elements 24 and 25 in order to enable the substantially simultaneous filling of the free space 12 between the outer periphery of the jacket tube 7 and the borehole inner wall 2 over the entire length of the jacket tube 7.

Alternatively, it is, for instance, possible to provide feed openings 22 radially about the periphery of the supply duct 21 each on the level of the respective passage openings 23 of the jacket tube 7, or individual jacket tube elements 8, 9 and 10, such that the supply duct 21, after the respective filling of partial regions of the free space 12, will be pulled out of the interior of the jacket tube 7 by an appropriate length in order to reach a position substantially in alignment with further passage openings 23 and thereby enable the free space 12 to be progressively filled, whereupon, prior to the final solidification of the curable fluid introduced into the free space 12, another tensioning of the anchor formed by the jacket tube 7 will be effected.

FIG. 5 schematically indicates the introduction of an additional anchorage 16 into the interior of the jacket tube 7, or individual jacket tube sections 8, 9 and 10, particularly after having filled the free space 12 between the outer peripheries of the individual jacket tube elements 8, 9 and 10 and the borehole inner wall 2.

It is apparent that, especially on the end 26 facing the interior of the borehole, the additional anchorage 16, which is, for instance, formed by a profiled solid rod, comprises guide elements 27 to enable the substantially central introduction of the solid rod 16. For a more extensive anchorage during the tensioning of the solid rod 16, it is provided that either the end 26 is engaged or coupled with the drill bit 4 or flap or hook elements, which are schematically indicated at 28 in the region of the guide 27, act against the extraction of the additional anchoring rod 16 in the sense of arrow 29 during tensioning, so that the anchoring effect will be enhanced by said additional anchorage 16.

In order to further increase the anchoring performance, in particular in cooperation with a profiled outer surface of the additional anchoring rod 16, even the annular or hollow space of the jacket tube 7 can be filled with a curable fluid upon introduction of the same.

FIG. 6 schematically illustrates fixing elements 15 used to secure the jacket tube 7 particularly on its end facing the interior of the borehole, wherein it is apparent that the fixing elements 15 are comprised of hook-shaped elements each capable of being pivoted about an axis denoted by 31, which are moved into engagement with the borehole inner wall schematically indicated by 2 during the tensioning of, or action on, the jacket tube 7 in the sense of arrow 11 in FIG. 1*c* , whereby, departing from the intermediate state represented in FIG. 6*b,* the state shown in FIG. 6*a* is reached to provide reliable anchoring. The fixing elements 15, which may be provided on an insertion element 30 about the periphery in an accordingly uniformly distributed manner immediately following the drill bit 4, thus ensure the safe anchoring of the anchor-forming jacket tube 7 such that no extraction of the anchor 7 from the bore 2 will be feasible during its subsequent tensioning in the sense of arrow 11 and a densification or compaction of the surrounding soil and rock material will be provided via the anchor 7 and the curable fluid present in the free space 12.

The invention claimed is:

1. A method for drilling a hole in soil or rock material and for forming an anchoring in said hole, said method comprising forming a borehole by introduction of a drill bit mounted on a drill rod assembly, introducing a jacket tube into the borehole during the drilling procedure, separating the drill rod assembly from the drill bit and removing the drill rod assembly from the borehole upon completion of the borehole, securing the jacket tube to a borehole wall in an end region facing the borehole interior, feeding a curable fluid into a free space between an outer periphery of the jacket tube and an inner periphery of the borehole wall, tensioning of the anchor-forming jacket tube prior to a final solidification of the curable fluid, and introducing the curable fluid into the free space between the outer periphery of the jacket tube and the inner periphery of the borehole wall via passage openings provided about a periphery of the jacket tube.

2. The method according to claim 1, wherein the curable fluid is fed through an interior of the jacket tube via a supply duct introduced into the interior of the jacket tube and having supply duct feed openings provided in a region of the passage openings of the jacket tube.

3. The method according to claim 2, wherein sealing elements for sealing an annular space formed between an outer periphery of the supply duct and the inner periphery of the jacket tube are provided on an outer periphery of the supply duct for the curable fluid, in a vicinity of feed openings for the curable fluid.

4. The method according to claim 1, wherein the jacket tube is designed to have an outer diameter increasing or widening towards the borehole interior at least on its outer periphery.

5. The method according to claim 4, wherein the jacket tube is comprised of mutually telescopically insertable jacket tube elements forming step-like regions on the outer periphery.

6. The method according to claim 1, wherein an additional anchorage is introduced into the interior of the anchor-forming jacket tube.

7. The method according to claim 6, wherein the additional anchorage is guided on the inner periphery of the jacket tube, on its end facing the borehole interior.

8. The method according to claim 6, wherein the additional anchorage is fixed or anchored to at least one of the drill bit and the jacket tube inner wall.

9. The method according to claim 6, wherein the interior of the jacket tube is filled with the curable fluid after the introduction of said additional anchorage.

10. A device for drilling a hole in soil or rock material and for forming an anchoring, said device comprising a drill bit for forming a borehole and a jacket tube introduced into the borehole during a drilling procedure, a drill rod assembly separated from the drill bit and removed from the borehole upon completion of the borehole, an anchor-forming jacket tube having a periphery formed with a plurality of passage openings for feeding a curable material into a free space between an outer periphery of the jacket tube and an inner periphery of a borehole wall, a tensioning means for an anchor plate and a screw capable of being screwed onto the jacket tube being fixable to a jacket tube end projecting out of the borehole, and anchoring or fixing elements for anchoring the jacket tube to the surrounding borehole wall being provided in a jacket tube end region facing the drill bit.

11. The device according to claim 10, wherein the curable material is feedable through an interior of the jacket tube via a supply duct introduced into the interior of the jacket tube and having supply duct feed openings provided in a region of the passage openings of the jacket tube.

12. The device according to claim 11, wherein sealing elements for sealing an annular space between an outer periphery of the supply duct and an inner periphery of the jacket tube are provided on an outer periphery of the supply duct for the curable material, in a vicinity of the feed openings for the curable material.

13. The device according to claim 10, wherein the jacket tube is comprised of mutually telescopically insertable jacket tube elements having outer peripheries or diameters decreasing from the jacket tube end arranged in the borehole.

14. The device according to claim 13, wherein the telescopic jacket tube elements are each formed in end regions with cooperating stops or stop surfaces.

15. The device according to claim 13, wherein wedge-shaped abutment surfaces enclosing acute angles with an axis of the jacket tube are provided in a region of the ends of the jacket tube elements.

16. The device according to claim 10, wherein the fixing elements are comprised of at least one foldout hook, which projects from an outer periphery of the jacket tube.

17. The device according to claim 10, wherein an additional anchoring element is introducible into an interior of the jacket tube.

18. The device according to claim 17, wherein the additional anchoring element comprises a guide facing the borehole, which guide is slidingly arranged, along an inner wall of the jacket tube.

19. The device according to claim 17, wherein the additional anchorage is comprised of a solid rod provided with an external profile.

20. The device according to claim 17, wherein the additional anchorage is fixable or anchorable to at least one of the drill bit and the jacket tube inner wall.

* * * * *